350-417 SR
XR 3,932,148

United St
Krewalk, Sr.

[11] 3,932,148
[45] Jan. 13, 1976

[54] METHOD AND APPARATUS FOR MAKING COMPLEX ASPHERIC OPTICAL SURFACES

[75] Inventor: John J. Krewalk, Sr., West Hartford, Conn.

[73] Assignee: Criterion Manufacturing Company, Inc., West Hartford, Conn.

[22] Filed: Jan. 21, 1975

[21] Appl. No.: 542,725

[52] U.S. Cl. ..... 51/284 R; 51/324
[51] Int. Cl.[2] ..... B24B 1/00; B24B 13/00
[58] Field of Search ..... 51/284 R, 283 R, 324, 51/216 LP, 235

[56] References Cited

UNITED STATES PATENTS

| | | | |
|---|---|---|---|
| 3,837,124 | 9/1974 | Johnson et al. | 51/324 |
| 3,837,125 | 9/1974 | Johnson | 51/324 |

*Primary Examiner*—Donald G. Kelly

[57] ABSTRACT

Complex aspheric optical surfaces may be made reliably and relatively rapidly by a method in which one surface of a relatively thick glass block is ground and polished to the desired aspheric surface, which may be tested in a system including master optics of the remaining components. This master die block may then be used to generate reverse die plates by drawing thin glass blanks against the configured surface thereof and polishing to an optical flat. These reverse die plates are then mounted on a base die block and deformable glass blanks are drawn against the configured surface thereof and the opposite surface polished to an optical flat. Upon removal, the glass blanks assume a curvature identical to the original aspheric surface of the master die block.

10 Claims, 11 Drawing Figures

3932148
OR IN 51/284R

METHOD AND APPARATUS FOR MAKING COMPLEX ASPHERIC OPTICAL SURFACES

BACKGROUND OF THE INVENTION

Various methods have been used for making complex aspheric optical surfaces, particularly for Schmidt corrector plates used in Schmidt-Cassegrain telescopes and Schmidt cameras. Various techniques have been proposed involving the drawing of the glass blank into contact with a die surface to facilitate reproduction to high accuracy. Illustrative of two of such methods are U.S. Pat. No. 3,837,124 granted Sept. 24, 1974 to Thomas J. Johnson and John F. O'Rourke, and U.S. Pat. No. 3,837,125 granted Sept. 24, 1974 to Thomas J. Johnson, both patents directed to a vacuum deformation technique using a configured die surface.

In Johnson U.S. Pat. No. 3,837,124, a two piece Schmidt corrector plate die assembly comprises a glass block and a thin glass die plate optically contacted therewith and having the inverse of the desired curve. This die plate is produced by first grinding and polishing a glass blank to the desired figure, locating its optical center, optically contacting this plate to a solid block with the central axis of the plate coinciding with the rotational axis of the block, and vacuum deforming a third glass piece onto this combination. This third glass piece is then ground and polished to become the inverse die plate in the master die.

Johnson U.S. Pat. No. 3,837,125 uses a thick one piece master die which itself is ground and polished to a curve inverse to that of the desired curve, rendering testing of the curve somewhat involved as test corrector plates must be produced therefrom for testing as the surface is being figured. The configuration of these test plates must be optically analyzed and the apparent corrections to the figure of the master die estimated. Then these corrections must be figured into the master die. If any changes are desired in the production plates which would necessitate refiguring the master die, this indirect testing procedure must be repeated.

Accordingly, it is an object of this present invention to provide a novel and relatively facile method for producing complex aspheric optical surfaces efficiently and accurately.

It is also an object to provide such a method wherein a one piece master die is used to make inversely curved die plates and is relatively rugged and is figured to the curve to be produced, thus facilitating direct optical testing.

Another object is to provide an apparatus for use in such a method.

SUMMARY OF THE INVENTION

It has now been found that the foregoing and related objects of the invention are readily attained in a method for making complex aspheric optical surfaces wherein a glass block is initially formed with a pair of substantially parallel flat surfaces. One parallel surface of the block is ground and polished to the desired aspheric configuration to form a master die block and then there is brought into contact with the aspheric surface of the master die block an optically flat surface of a deformable glass blank. A vacuum is drawn through the master die block to deform the glass blank into optical contact with the aspheric surface, and the opposite surface of the glass blank is ground and polished to substantially an optical flat to provide a die plate. Upon releasing the vacuum and removing the die plate from the master die block, the opposite surface of the die plate assumes a configuration substantially inverse to that of the aspheric surface of the master die block. Thereafter the optically flat surface of the die plate is brought into optical contact with an optically flat surface of a base die block to form a die block assembly with the aspherically configured surface of the die plate being exposed and providing a configuration substantially inverse to that of the aspheric surface of the master die block.

Once a die block assembly has been formed a finished optical surface is made therefrom by bringing into contact with the aspherically configured surface of the die block assembly an optically flat surface of a deformable glass plate and drawing a vacuum through the die plate to deform the glass plate into optical contact with the aspherically configured surface. The opposite surface of the glass plate is ground and polished to substantially an optical flat, the vacuum is released and the glass plate is removed from the die block assembly. The opposite surface of the glass plate then assumes a configuration substantially conforming to that of the aspheric surface of the master die block.

In its preferred aspect the method of the present invention includes the additional step of forming at least one passage through the master die block extending from the aspheric surface to another surface thereof and drawing the vacuum therethrough. Grooves are formed in the optically flat surface of the glass blank and communicate with the passage through the master die block to facilitate drawing the vacuum between the glass blank and master die block. In customary practice, the opposite surface of the glass blank is normally ground and polished to an optical flat.

Also in its preferred aspect, the method includes the additional step of forming at least one passage through the base die block and die plate, the passage through the base die block and die plate communicating upon formation of the die block assembly and extending from the aspherically configured surface to another surface thereof. Grooves are formed in the aspherically configured surface of the die plate and communicate with the passage therethrough to facilitate drawing the vacuum between the die plate and the glass plate to be figured thereon. The opposite surface of the glass plate is normally ground and polished to an optical flat.

Thus the present invention utilizes a unique assembly for making inverse curve die plates for the production of complex aspheric optical surfaces comprising a master die block and a deformable glass blank wherein the master die block has one surface with the desired aspheric configuration and at least one passage extending therethrough from the aspheric surface to another surface thereof and may be tested to ensure that it has the desired figure. The glass blank has an optically flat surface with grooves therein disposed adjacent and drawn into optical contact with the aspheric surface of the master die block to conform thereto, and its grooves communicate with the passage in the master die block for drawing of the vacuum therebetween. In accordance with usual practice, the exposed surface of the glass blank opposite the optically flat surface is ground optically flat while in this assembly.

DETAILED DESCRIPTION OF THE PREFERRED EMBODIMENT

Figure 1:
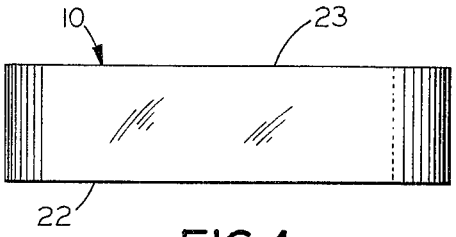
FIG. 1 is an elevational view of a glass block used in the present invention prior to grinding and polishing.
Figure 2:
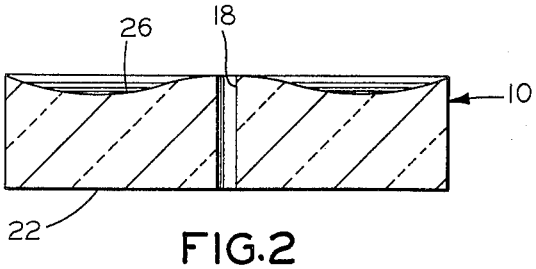
FIG. 2 is a cross sectional view of the glass die block formed into a master die block.

Turning now to the attached drawings in detail, FIGS. 1 and 2 illustrate the method of generating the initial thick master die block. In FIG. 1, there is shown a thick glass block generally designated by the numeral 10 which is selected to ensure good optical properties and has good anneal. Its diameter is greater than that of the desired aspheric of the final optical product and the composition of the glass is one which will ensure long life. Its thickness may vary but should be sufficiently great to ensure freedom from deformation and a high degree of structural strength. As seen the die block 10 is of disc-shaped configuration and it has its major parallel surfaces 22, 23 initially polished to an optical flat and substantially absolute parallelism.

Known methods are used to grind and polish the surace 23 to the desired aspheric configuration to form the curved surface 26 illustrated in FIG. 2. Using a die block 10 with parallel optically flat surfaces 22, 23 effectively eliminates any tendency for a wedge effect which might result in the event that the surfaces were not parallel prior to figuring. After grinding and polishing the estimated rough curve, the die block 10 may be tested readily and directly to determine the further figuring required by assembling the die block 10 in an optical test stand (not shown) which simulates the complete optical system for which the final optical piece is intended. The master die block 10 substitutes for the final optical element which is to be produced therefrom and thus any deviations from the desired curve may be determined readily against precisely formed master optical components for the other elements of the optical system. Standard testing methods may be used to determine any portion of the curved surface 26 of the die block which is overcorrected or undercorrected and/or zonal problems. The corrections required to the curved surface 26 may thus be determined directly upon that curved surface and these corrections polished into the curved surface 26 during further figuring operations. This process of polishing, direct testing and refiguring may be repeated until the curved surface 26 reaches the desired degree of optical perfection.

The final master die block 10 is illustrated in FIG. 2 and includes a central passage 18. This passage may be provided prior to the grinding and polishing operation or subsequent thereto; if provided previously, it should be plugged during the grinding and polishing operation and unplugged thereafter.

Figure 3:
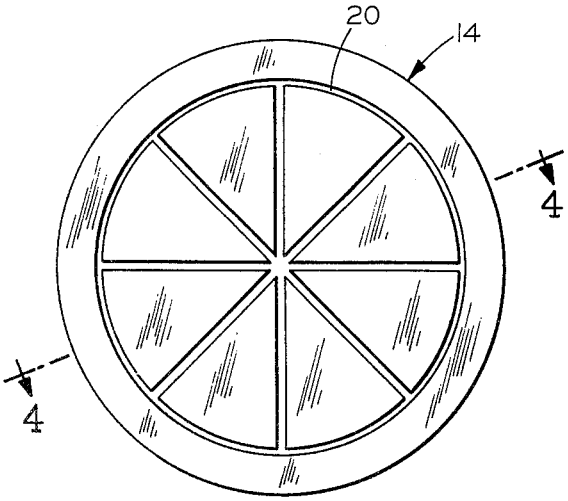
FIG. 3 is a bottom view of a thin glass blank used to produce a reverse die plate.
Figure 4:
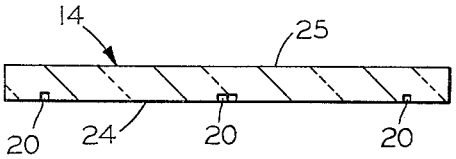
FIG. 4 is a cross sectional view of the glass blank along the line 4—4 of FIG. 3.

Following completion of the master die block 10 shown in FIG. 2, it is then used to produce large numbers of inverse die plates generally designated by the numeral 14 by the method partially diagrammatically illustrated in FIGS. 3–7. Turning first to FIGS. 3 and 4, a relatively thin deformable glass blank generally designated by the numeral 14 is of disc-shaped configuration with parallel surfaces 24 and 25. The surface 24 is initially ground and polished to an optical flat and is provided with a circumferential and radial grooves 20. The surfaces of the glass blank 14 must be free from burrs and the glass must be free of striae.

Figure 5:
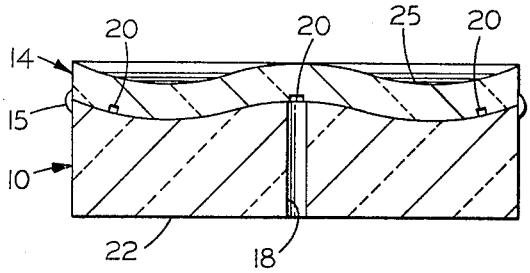
FIG. 5 is a cross sectional view of the thin glass blank of FIG. 3 vacuum deformed into optical contact with the master die block of FIG. 2.

As seen in FIG. 5, the glass blank 14 is placed upon the master die block 10 with its optically flat surface 24 against the curved surface 26 of the master die block 10. The grooves 20 communicate with the passage 18 in the master die block 10 and a sealant compound 15 is placed about the circumferential joint between the die block 10 and glass blank 14. When vacuum is now drawn through the central passage 18, the glass blank 14 is drawn downwardly and deformed into optical contact with the aspheric surface 26 of the master die block 10 to produce the assembly illustrated in FIG. 5.

Figure 6:
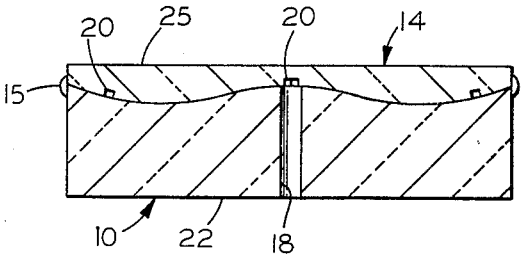
FIG. 6 is a cross sectional view of the assembly of FIG. 5 with the upper surface of the glass blank ground and polished flat to provide a die plate.
Figure 7:
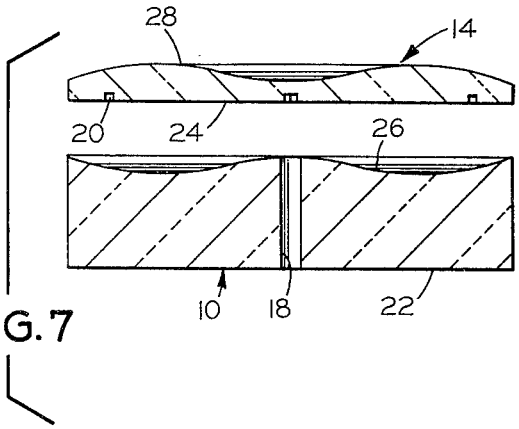
FIG. 7 is a cross sectional view of the assembly of FIG. 6 after the vacuum is released and the die plate removed.

In the next step, while the vacuum maintains the glass blank 14 in the deformed condition, the surface 25 of the glass blank is ground and polished to an optical flat as seen in FIG. 6. Upon release of the vacuum and separation of the glass blank 14 from the master die block 10, the glass blank 14 returns to its undeformed condition and assumes the configuration shown in FIG. 7 wherein the surface 25 becomes the aspheric surface 28 with a curve inverse to that of the curve 26 of the master die block 10. The die plate 14 is then provided with a central passage 23 (shown in FIG. 8) and it may be provided with a similar pattern of circumferential and radial grooves 21 (also seen in FIG. 8) in the aspheric surface 28 at this stage of operation. The surfaces of the inverse die plate 14 thus produced are thoroughly cleaned and the die plate is checked to ensure freedom from flaws.

Figure 8:
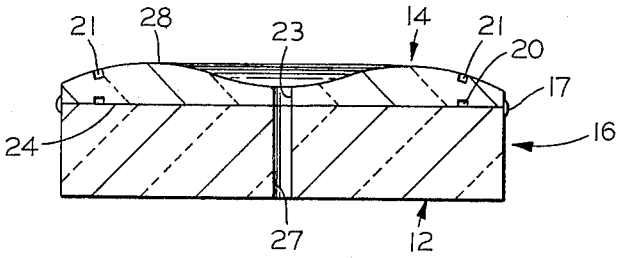
FIG. 8 is a cross sectional view of a die block assembly provided by the die plate of FIG. 7 mounted upon a base die block.

The inverse die plate 14 is thereafter utilized to form a die block assembly illustrated in FIG. 8. More particularly, a relatively thick glass block generally designated by the numeral 12 having its parallel surfaces polished to optical flatness is of generally disc-shaped configuration and has a central passage 27 extending therethrough. This glass block 12 forms the base portion of the die block assembly and should be carefully selected for good optical properties and be of durable composition. Its surfaces are scrupulously cleaned, and the grooved surface 24 of the inverse die plate 14 is then brought into optical contact with one of the optically flat surfaces of the base die block 12 so that the central passages 23 and 27 are aligned. A sealant 17 is placed about the circumferential joint between the inverse die plate 14 and base die block 12. If so desired, the circumferential and radial grooves 21 in the die plate surface 28 may be ground at this point because of the increased support for the die plate 14 rather than at the prior stage following separation from the master die block 10. The resultant composite structure comprises the die block assembly generally designated by the numeral 16.

Figure 9:
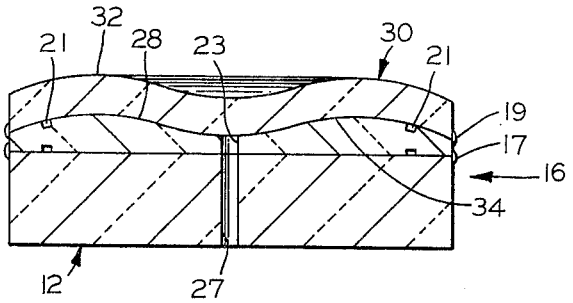
FIG. 9 is a cross sectional view of the assembly of FIG. 8 with a thin glass blank vacuum deformed into optical contact therewith.

In the next step of the method, a deformable glass blank 30 of generally disc-shaped configuration is carefully selected to ensure good optical properties. It is ground and polished to optical flatness on at least one of its parallel surfaces 32, 34 and one of the optically flat surfaces 34 is placed in contact with the aspheric surface 28 of the die block assembly 16. Sealant 19 is placed about the circumferential joint between the glass blank 30 and inverse die plate 14, and a vacuum is then drawn through the passages 27 and 23 to deform the glass blank 30 into optical contact with the surface 28 of the die block assembly 16, as seen in FIG. 9.

Figure 10:
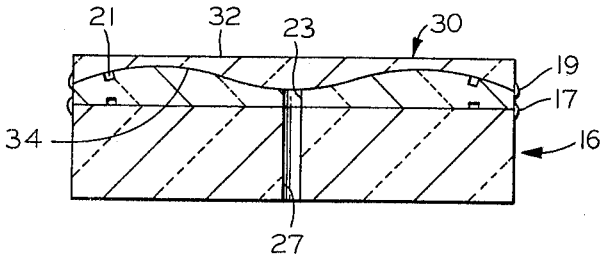
FIG. 10 is a cross sectional view of the assembly of FIG. 9 with the upper surface of the glass blank ground and polished flat.
Figure 11:
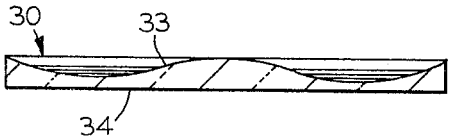
FIG. 11 is an elevational view of the finished optical piece after removal from the assembly of FIG. 10 and release into undeformed condition.

In the next step, the exposed surface 32 of the glass blank 30 is ground and polished to optical flatness with the glass blank 30 maintained in deformed optical contact with the inverse die plate 14 of the die block assembly 16. The resultant condition of the glass blank 30 is illustrated in FIG. 10 prior to release of the vacuum and removal of the glass blank 30 therefrom.

Lastly, the vacuum being drawn through the passages 27 and 23 of the die block assembly 16 is released, the sealant 19 removed and the glass blank 30 separated from the die block assembly 16. Upon separation the glass blank 30 assumes its undeformed condition with the surface 32 as seen in FIGS. 9 and 10 assuming an aspheric curved configuration 33 identical to the aspheric surface 26 of the master die 10. The opposite surface 34 which has previously been polished to an optical flat returns to its normal optical flat condition. The finished optical plate 30 is thereafter cleaned and inspected to ensure freedom from flaws and may be tested directly in a same or similar optical test bench.

In order to ensure complete optical contact of the glass plate being formed over the full surface area to be configured, it is frequently desirable to make the master die and die block assembly somewhat larger than the intended diameter for the finished piece, particularly where th curve is relatively steep on the order of *f*/2. This accommodates the tendency for the glass plate to tend to pull up about the circumference during the grinding and polishing operations in the event that the seal about the joint therebetween should fail. For example, in the manufacture of finished Schmidt corrector plates of 8 inches diameter, the dies and the glass blanks employed are conveniently 10 inches in diameter with the circumferential portion being removed at the end of the fabricating operation. However, where the curve is relatively shallow (on the order of *f*/5), it is much easier to draw the plate into full contact over the entire surface.

It is extremely important that the dies and the glass plates being formed into the finished product be coaxially aligned to ensure concentricity within the system and to permit interchangeability. This is most conveniently accomplished by grinding the disc-shaped pieces being employed to fabricate the die components and the glass blanks being processed to close tolerance as to diameter and to circumference. In practice a tolerance of not more than about 0.001 inch should be held to obtain superior results. The disc-shaped elements may then be concentrically aligned using the ground circumferential edges and dial indication to ensure dimensional and configurational accuracy.

This high degree of control of the circumferential dimension and configuration facilitates other operations such as the coring operations necessary to provide the through passages for drawing the vacuum and the cutting operations to provide the grooves. The glass disc may be disposed within a precision cavity of a jig or other suitable holding apparatus and the various points determined from the periphery. Moreover, after precision coring of the center passage of the final product, the peripheral portion may be removed by then locating in the precision core a radial arm cutter which will cut away the peripheral portion as it is rotated about the core.

The number and pattern of the grooves to assist in drawing the vacuum over the entire contact surface area may vary depending upon the size of the components, the amount of vacuum to be drawn and the amount of deformation desired as well as the thickness of the glass elements being deformed. The wheel and spoke pattern illustrated serves efficiently with the circumferential groove being located close to the outer edge of the glass area intended to be used. As seen the grooves communicate with the passage through which the vacuum is being drawn and serve to distribute the applied vacuum over the contact surface. The grooves should be relatively shallow to maintain the strength of the glass and should be relatively narrow to preclude any tendency of the glass being deformed thereinto.

In the described process only a central passage through the master die block and die block assembly is shown, but a plurality of passages may be used and may extend from anywhere on the curved surface of the die block to the opposite or a lateral surface. The surfaces of the master die block are generally ground and polished parallel prior to figuring one surface thereof but any wedge may be ground out during the figuring process.

The surfaces of the vacuum deformed glass blank and glass plate are generally ground and polished optically flat, but a curvature may be figured thereinto if changes are desired in the finished optical surface while retaining the configuration of the master die block. Otherwise, the master die block may be refigured, tested, and optical pieces having completely different aspheric surfaces produced therefrom.

The master die block, base die block, and reverse die plate are most preferably formed of Cervit, quartz or fused silica, but may be of any glass having comparable durability and a low thermal coefficient of expansion. The corrector plates are normally made from plate glass having good optical qualities, but certainly other glass may be used. The sealing substance used is wax or, if a semi-permanent bond is desired, fingernail polish, but clearly comparable substitutes may be used therefor.

Thus, it can be seen from the foregoing specification and drawings that the method of the present invention provides a novel and relatively facile method for producing complex aspheric optical surfaces. A solid, rugged master die with one surface having the curve to be produced is used, thus facilitating direct testing thereof.

Having thus described the invention, I claim:

1. In a method for making complex aspheric optical surfaces, the steps comprising:

a. forming a thick, non-deformable integral glass block with a pair of substantially parallel flat surfaces;

b. grinding and polishing one parallel surface of said block to the desired aspheric configuration to form a thick, non-deformable integral master die block;
c. bringing into contact with said aspheric surface of said master die block an optically flat surface of a deformable glass blank;
d. drawing a vacuum through said master die block to deform said glass blank into optical contact with said aspheric surface;
e. grinding and polishing the opposite surface of said glass blank to substantially an optical flat to provide a die plate;
f. releasing said vacuum and removing said die plate from said master die block, said opposite surface of said die plate assuming a configuration substantially inverse to that of said aspheric surface of said master die block;
g. bringing said optically flat surface of said die plate into optical contact with an optically flat surface of a base die block to form a die block assembly with the aspherically configured surface of said die plate being exposed and providing a configuration substantially inverse to that of said aspheric surface of said master die block;
h. bringing into contact with said aspherically configured surface of said die block assembly an optically flat surface of a deformable glass plate;
i. drawing a vacuum through said die plate to deform said glass plate into optical contact with said aspherically configured surface;
j. grinding and polishing the opposite surface of said glass plate to the desired flatness; and
k. releasing said vacuum and removing said glass plate from said die block assembly, said opposite surface of said glass plate assuming a configuration substantially conforming to that of said aspheric surface of said master die block.

2. In the method of claim 1, the additional step comprising forming at least one passage through said base die block and at least one passage through said die plate, said passage through said base die block extending from the optically flat surface to another surface thereof and said passage in said die plate extending from the optically flat surface to the aspherically configured surface thereof, said passages in said base die block and die plate communicating upon formation of said die block assembly, and wherein said vacuum is drawn through said passages.

3. In the method of claim 2, the additional step comprising forming grooves in said aspherically configured surface of said die plate, said grooves communicating with said passage through said die plate to facilitate drawing the vacuum between said die plate and the glass plate to be configured thereon.

4. In the method of claim 1, the additional step comprising forming at least one passage through said master die block, said passage extending from said aspheric surface to another surface thereof and wherein said vacuum is drawn through said passage.

5. In the method of claim 4, the additional step comprising forming grooves in said optically flat surface of said glass blank, said grooves communicating with said passage through said master die block to facilitate drawing the vacuum between said glass blank and said master die block.

6. The method of claim 1 wherein both of said surfaces of said glass block are ground and polished to parallel relationship and an optical flat.

7. The method of claim 1 wherein said opposite surface of said glass blank is ground and polished to an optical flat.

8. In a method for making complex aspheric optical surfaces, the steps comprising:
a. forming a thick, non-deformable integral glass block with a pair of substantially parallel flat surfaces;
b. grinding and polishing one parallel surface of said glass block to the desired aspheric configuration to form a thick non-deformable integral master die block;
c. forming at least one passage through said master die block extending from said aspheric surface to another surface thereof;
d. forming grooves in an optically flat surface of a deformable glass blank;
e. bringing said optically flat surface of said glass blank into contact with said aspheric surface of said master die block;
f. drawing a vacuum through said passage to deform said glass blank into optical contact with said aspheric surface, said grooves communicating with said passage to facilitate drawing the vacuum between said glass blank and said master die block;
g. grinding and polishing the opposite surface of said glass blank to substantially an optical flat to provide a die plate;
h. releasing said vacuum and removing said die plate from said master die block, said opposite surface of said die plate assuming a configuration substantially inverse to that of said aspheric surface of said master die block;
i. bringing said optically flat surface of said die plate into optical contact with an optically flat surface of a base die block to form a die block assembly with the aspherically configured surface of said die plate being exposed;
j. forming grooves in said aspherically configured surface of said die plate;
k. forming at least one passage through said die plate communicating with said grooves and at least one passage through said base die block, said passage through said die plate extending from the optically flat surface to the aspherically configured surface, said passage through said base die block extending from the optically flat surface to another surface thereof, said passages in said die plate and said base die block communicating upon formation of said die block assembly;
l. bringing into contact with said aspherically configured surface of said die block assembly an optically flat surface of a deformable glass plate;
m. drawing a vacuum through said communicating passages in said die block assembly to deform said glass plate into optical contact with said aspherically configured surface;
n. grinding and polishing the opposite surface of said glass plate to the desired flatness; and
o. releasing said vacuum and removing said glass plate from said die block assembly, said opposite surface of said glass plate assuming a configuration substantially conforming to that of said aspheric surface of said master die block.

9. The method of claim 8 wherein said opposite surface of said glass plate is ground and polished to an optical flat.

10. The method of claim 8 wherein said opposite surfaces of said glass blank is ground and polished to an optical flat.

* * * * *